United States Patent [19]

Finch

[11] 4,164,010

[45] Aug. 7, 1979

[54] ILLUMINATED BANK WINDOW

[76] Inventor: David H. Finch, 5205 Quail Meadows Dr., Raleigh, N.C. 27609

[21] Appl. No.: 863,076

[22] Filed: Dec. 22, 1977

[51] Int. Cl.[2] ..... F21S 1/02

[52] U.S. Cl. ..... 362/147; 362/217; 362/310; 362/339

[58] Field of Search ..... 362/33, 125, 145–147, 362/217, 309, 310, 329, 339, 432, 812, 197; 109/19

[56] References Cited

U.S. PATENT DOCUMENTS

| | | | |
|---|---|---|---|
| 1,314,513 | 9/1919 | Donahue | 362/145 X |
| 2,912,066 | 10/1959 | Ellithorpe | 109/19 |
| 3,059,840 | 10/1962 | Graber et al. | 109/19 X |
| 3,340,393 | 9/1967 | Franck et al. | 362/309 |
| 3,681,591 | 8/1972 | Loch | 362/217 |
| 4,027,151 | 5/1977 | Barthel | 362/217 |
| 4,078,169 | 3/1978 | Armstrong | 362/217 X |

*Primary Examiner*—Peter A. Nelson

[57] ABSTRACT

A bank window of the type mounted in the wall of a bank building and having a large window and a movable drawer through which bank transactions may be made so constructed as to provide a light source along the upper edge of the window frame which casts light rays asymmetrically therefrom somewhat downwardly, but mostly outwardly therefrom into the area beneath a car roof pulled up beside the window to better illuminate the inside of the automobile for purposes of identifying the occupants.

3 Claims, 2 Drawing Figures

ILLUMINATED BANK WINDOW

BACKGROUND OF THE DISCLOSURE

In recent years banking institutions have decentralized considerably to the extent that many small branch offices now exist in communities where formerly banking was done at a central downtown location. Generally each of these branch offices is provided with one or more drive-in teller windows for the convenience of customers where customers may drive up in their automobile, conduct their banking transaction through the window which includes a drawer that slides out into which deposits are made and receipts taken.

One of the problems in such a system is for the tellers to be able to identify the person in the automobile. At certain times, particularly in the late afternoon hours when it is darker, it is difficult for the teller to identify the occupants of the automobile because of the darkness therein. Although overhead lights have been provided in the parking lots and under the porticos which are sometimes provided, the roof creates a shadow within the car which still makes difficult the tellers task of identifying the occupants therein.

Further lights positioned obviously for customer identification would be offensive to the customer. A normal fixture above the teller window is also not the answer as the light rays would be directed toward the teller, tending to blind and thus defeat the purpose.

SUMMARY OF THE PRESENT INVENTION

According to the present invention, bank windows of the type formed in the walls of bank buildings and through which transactions are made between a customer in his automobile and a teller within the bank are provided with a lighting apparatus extending generally parallel to and adjacent the upper horizontal member of the frame surrounding the window. The lighting apparatus includes a source of light therein and a system of reflectors and/or refractors so designed to cause the major portion of the light emanating therefrom to leave the light housing in a path having a substantial horizontal component. The light thus enters the automobile beneath the roof and sufficiently illuminates the inside thereof so that a teller can more easily and discretely identify the occupants.

Various luminaries might be utilized within the scope of the present invention, however, it is important that the selected housing should be mounted in the area of the upper frame member of the window. So mounted the light should be reflected, refracted and diffused in such a way that very little, if any, of the light emanates rearwardly toward the window, and most of the light is delivered outwardly with a slight downward incline.

It is therefore an object of the present invention to provide a light housing for use in combination with bank teller windows which makes it more easy for the tellers to see and identify the occupants in automobiles positioned adjacent thereto.

It is another object of the present invention to provide a lighting apparatus which is mounted along the upper edge of the bank window and so discretely directs a major portion of the light emanating therefrom outwardly, rather than downwardly or rearwardly.

Other objects and a fuller understanding of the invention will become apparent upon reading the following detailed description of a preferred embodiment along with the accompanying drawings in which.

DETAILED DESCRIPTION OF A PREFERRED EMBODIMENT

Figure 1:
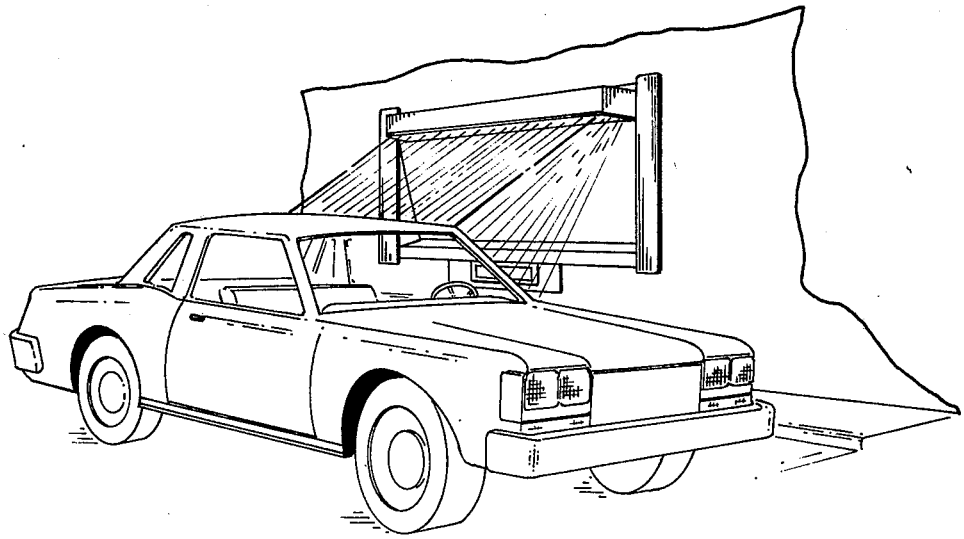
FIG. 1 is a perspective view illustrating environmentally a bank window having the light housing according to the present invention attached thereto.

Turning now to the drawings, and first of all, to FIG. 1, there is environmentally illustrated a portion of the side wall of a bank building having a teller's window T mounted therein of the type contemplated by the present invention and adjacent which an automobile A is parked to transact business with a teller inside the bank. The window is of the type having generally vertical side frame members 10,12, a bottom frame member 14, an upper frame member 16, all surrounding a large plate of tinted glass 20, usually of the security or bulletproof type. A sliding drawer 18 is operated from within the bank to pass checks, money, deposit slips, and the like between the occupant of automobile A and a teller within the bank.

The problem existing prior to the present invention is that with street lights, or even in situations where a portico extends out over the area under which the automobile drives and lights exist in the portico, the roof of the automobile A creates a shadow within the car which makes it difficult for the teller to identify the occupants thereof. On the other hand, a light mounted on or adjacent the window height and so arranged to shine directly into the car would be blinding to the customer as well as being offensive to the customer's integrity. Good banking practices dictate discrete security measures. Therefore, within the scope of the present invention a lighting apparatus 22 with certain desired light directing devices is mounted generally parallel to and adjacent the upper horizontal member 16 of the bank window. One example of a preferred type of light housing 22 is more particularly described with reference to FIG. 2 hereinbelow.

Figure 2:
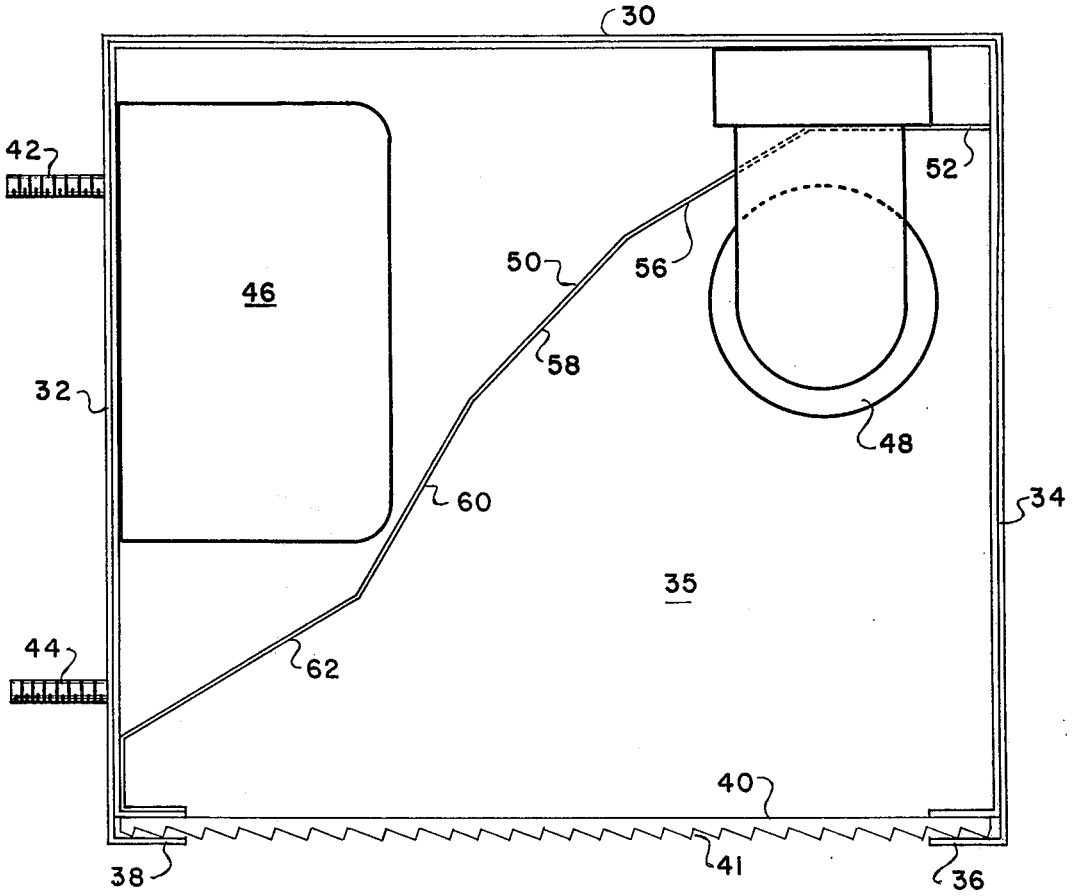
FIG. 2 is a sectional view of a light housing which would be suitable for use in the present invention.

While various structures might be suitable for use in the present invention, the light housing 22 of FIG. 2 has been found to be very adequate in providing a light distribution of the type desired. Light housing 22 includes an elongated upper wall 30 having a rear wall 32 depending from the rear edge thereof, a front wall 34 depending from the front edge thereof, and side walls 35 enclosing either end. Channel sections 36,38 depend inwardly from the respective lower edges of front wall 34 and rear wall 32 for the purpose of receiving a refractor or diffuser 40 therein.

A plurality of threaded studs 42,44 depend rearwardly from the rear wall 32 for mounting the housing to the front of upper member 16 of the window T (FIG. 1). While this is the type of mounting which would probably be more appropriate in the window illustrated, other bank windows might have the light housing 22 attached to the undersurface of the upper window in which case the threaded fasteners 42 extend upwardly from the upper wall 30. Alternatively, the light housing 22 might be recessed within the upper member 16 of the bank window, or could even be suspended separately from the wall of the bank building as long as they were position substantially parallel to and closely adjacent the upper member 16.

Within the housing 22 is mounted a ballast 46 and an elongated light source 48, preferably of the florescent type. The light source 48 is generally positioned in the upper front portion of the housing. An elongated reflector means 50 extends substantially the length of the housing 22 and covers the ballast 46 and wires associated with the fixtures. The reflector 50 is so positioned between the light source 48 and the top and rear walls 30,32 respectively that it extends angularly from the top front portion of the housing along a path generally toward the bottom rear portion. Additionally, the reflector 50 is formed of segments 52, 56, 58, 60, and 62 which are substantially equal in length and angularly offset from each other to achieve the desired generally horizontally emitted light pattern. Additionally, the refractor or diffuser 40 may include prisms 41 to aid in directing the light rays along a path having a generally horizontal component and somewhat downward component.

So arranged, the major portion of the light from the light source, when activated, shines along a path having a substantial forwardly or outwardly directed vector, while only a minor portion of the light is directed along a path having a rearwardly directed vector.

Although a preferred embodiment has been described in detail hereinabove, it is apparent that minor changes and alterations in the lighting apparatus itself might be made without departing from the scope of the invention which is set forth in the following claims:

What is claimed is:

1. In combination with a bank window construction of the type mounted in a building wall and including a frame having an upper horizontal member and a window so mounted in said wall that automobiles may stop therealong and transact business with a teller on the other side of the window, a lighting apparatus comprising:

(a) a light housing extending generally parallel to said upper horizontal member of said frame and having means associated therewith for mounting the housing adjacent the upper frame member;

(b) said light housing including opaque front, rear, top and side walls, and a light transmitting bottom wall, an elongated light source mounted in said housing parallel to the front wall and substantially in the forward portion of said housing;

(c) said light housing further including an elongated reflector means extending substantially the entire length of said housing and positioned above and behind said light source;

(d) said light transmitting bottom wall being provided with at least a prismatic surface portion;

(e) said light source, reflector, and prismatic surface so arranged with relation to each other that the major portion of the light from said light source, when activated, is directed from said apparatus along an asymmetric path having a forwardly directed vector, while only a minor portion of the light is directed along the path having a rearwardly directed vector.

2. The combination according to claim 1 wherein said light source is positioned in the upper portion of said housing nearer the front wall than the rear wall.

3. The combination according to claim 2 wherein said reflector extends angularly from the top portion of said housing generally toward the bottom rear portion.

* * * * *